US008727486B2

(12) United States Patent
Kawabata

(10) Patent No.: US 8,727,486 B2
(45) Date of Patent: May 20, 2014

(54) IMAGE FORMING APPARATUS

(75) Inventor: Yoichi Kawabata, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 618 days.

(21) Appl. No.: 12/467,416

(22) Filed: May 18, 2009

(65) Prior Publication Data

US 2009/0289992 A1 Nov. 26, 2009

(30) Foreign Application Priority Data

May 20, 2008 (JP) ..... 2008-131479

(51) Int. Cl.
*B41J 2/165* (2006.01)

(52) U.S. Cl.
USPC ..... 347/33

(58) Field of Classification Search
None
See application file for complete search history.

(56) References Cited

U.S. PATENT DOCUMENTS

| | | | | |
|---|---|---|---|---|
| 5,905,514 | A * | 5/1999 | Rhoads et al. | 347/33 |
| 7,188,927 | B2 * | 3/2007 | Anderson et al. | 347/33 |
| 2005/0146554 | A1 | 7/2005 | Asanuma et al. | |

FOREIGN PATENT DOCUMENTS

| | | |
|---|---|---|
| JP | 9-314852 | 12/1997 |
| JP | 2003-80720 | 3/2003 |
| JP | 2003-205619 | 7/2003 |
| JP | 2005-144912 | 6/2005 |
| JP | 2005-169985 | 6/2005 |
| JP | 2005-349785 | 12/2005 |
| JP | 2007-175865 | 7/2007 |

OTHER PUBLICATIONS

Machine trannslation of Toshitaka et al. (JP 2005-144912A).*
Jul. 3, 2012 Japanese office action of the Japanese Patent Office in connection with Japanese patent application No. 2008-131479.

* cited by examiner

*Primary Examiner* — Alejandro Valencia
(74) *Attorney, Agent, or Firm* — Cooper & Dunham LLP

(57) ABSTRACT

An image forming apparatus is disclosed that includes an ejecting head including a nozzle from which an ink is ejected; a wiper member configured to wipe ink from a surface of the nozzle of the ejecting head; a wiper cleaning portion configured to remove an ink attached to the wiper member when the wiper member is pressed against the wiper cleaning portion, a scraping member actuated in a longitudinal direction of the wiper cleaning portion reciprocatively, and configured to scrape ink attached to the wiper cleaning portion; and a cleaning member configured to remove ink accumulated on the top portion of the scraping member.

10 Claims, 11 Drawing Sheets

IMAGE FORMING APPARATUS

BACKGROUND OF THE INVENTION

1. Technical Field of the Invention

This disclosure generally relates to an image forming apparatus, and particularly relates to an image forming apparatus including an ejecting head which ejects a liquid and a maintaining mechanism that maintains the ejecting head.

2. Description of the Related Art

An inkjet recording apparatus is known as a liquid eject recording type image forming apparatus including, for example, an ejecting head which ejects an ink liquid. The liquid eject recording type image forming apparatus may be used as an image forming apparatus of a printing machine, a facsimile machine, a copier, a plotting machine, or a complex machine thereof.

The liquid eject recording type image forming apparatus forms an image on a surface of a paper by ejecting an ink liquid from the ejecting head to the paper. There are two types of liquid eject recording type image forming apparatuses. One is a serial type image forming apparatus which forms an image by scanning an ejecting head in the direction of main scanning direction and by ejecting an ink liquid from the ejecting head. The other is a line type image forming apparatus which includes a line type head and forms an image by ejecting an ink liquid from the line type head without scanning the line type head.

Herein, the terms "image forming" are used to indicate "recording", "printing a letter, a numeral, or a symbol", "printing an image", and/or "printing a document".

The liquid eject recording type image forming apparatus of the present invention is an image forming device that forms an image by forming an ink liquid on a surface of a paper, a thread, textiles, a fabric, a leather, a metal, a plastic, a glass, a wood, or a ceramic etc. The terms "forming image" are used to indicate not only forming a letter or a figure that have a meaning, but also simply forming an ink liquid on a medium, i.e. forming a pattern etc. that does not have a meaning. The term "ink" is used as an all-inclusive term which means a liquid that can form an image. Thus, the term "ink" may include a recording liquid, a fixing liquid, a liquid body etc. besides so-called ink. Further, the term "sheet" is used as an all-inclusive term which means a medium to be recorded, a recording medium, a recording paper, or a recording paper sheet etc. Thus, the term "sheet" may include not only a paper sheet, but also an OHP sheet, or textiles etc.

The liquid eject recording type image forming apparatus as described above includes the ejecting head which ejects an ink liquid and the maintaining mechanism which maintains the performance of the ejecting head by restoring the ejecting head. The ejecting head includes a nozzle surface from which the ink liquid is ejected, and the maintaining mechanism includes a cap (a cap member) that seals the nozzle surface of the ejecting head. Further, the liquid eject recording type image forming apparatus includes a suctioning function of suctioning an ink liquid in the ejecting head by a suctioning apparatus such as a suction pump which is communicated with the cap of the ejecting head, a wiping function of wiping a surface of the ejecting head by a wiper blade (a wiper member) which is made of an elastic member such as a rubber member, and a pre-ejecting function of ejecting an ink liquid to and around the nozzle in order to remove a thickened ink and a color mixed ink attached thereto. The liquid eject recording type image forming apparatus removes a bubble and a thickened ink in a reservoir, and a particle attached to and around the nozzle, in order to maintain the condition of the ejecting head by using above described functions.

Patent documents 1 and 2 disclose liquid eject recording type image forming apparatuses which include a wiper cleaning member such as a wiper cleaner or a blade cleaner that cleans a wiper member by removing ink attached thereto.

[Patent Document 1] Japanese Patent Laid-Open Publication No. 2003-80720

[Patent Document 2] Japanese Patent Laid-Open Publication No. 09-314852

In a case where a greatly thickened ink is transferred to a wiper cleaning member from a wiper member, the ink remains attached to the wiper cleaning member. It then becomes difficult for the wiper cleaning member to remove the ink from the wiper member when the wiper cleaning member cleans the wiper member. This results in decreasing the wiping performance of the wiper member. Thus, patent document 3 discloses a scraping apparatus that scrapes the ink attached to the wiper cleaning member.

[Patent Document 3] Japanese Patent Laid-Open Publication No. 2005-144912

In a case where an evaporation rate of an ink is high and the ink has a greater tendency to be thickened than a general ink, the ink remains attached to the scraping apparatus and the ink transferred to the scraping apparatus from the wiper cleaning member is deposited onto the scraping apparatus. Thus, the ink attached to the scraping apparatus may contact the ejecting head, and the ejecting head and the sheet may be spotted.

BRIEF SUMMARY

In an aspect of this disclosure, there is provided an image forming apparatus that can decrease the amount of the ink attached to the scraping member, and thus decrease the contact of the ink to the ejecting head and a smear of the sheet.

Features and advantages of the present invention will be set forth in the description which follows, and in part will become apparent from the description and the accompanying drawings, or may be learned by practice of the invention according to the teachings provided in the description. Objects as well as other features and advantages of the present invention will be realized and attained by an image forming apparatus particularly pointed out in the specification in such full, clear, concise, and exact terms as to enable a person having ordinary skill in the art to practice the invention.

In an aspect of this disclosure, there is provided an image forming apparatus including: an ejecting head including a nozzle from which an ink is ejected; a wiper member configured to wipe ink from a surface of the nozzle of the ejecting head; a wiper cleaning portion configured to remove an ink attached to the wiper member when the wiper member is pressed against the wiper cleaning portion, a scraping member actuated in a longitudinal direction of the wiper cleaning portion reciprocatively, and configured to scrape ink attached to the wiper cleaning portion; and a cleaning member configured to remove ink accumulated on the top portion of the scraping member.

In another aspect, there is provided an image forming apparatus including: an ejecting head including a nozzle from which an ink is ejected; a wiper member configured to wipe ink from a surface of the nozzle of the ejecting head; a wiper cleaning portion configured to remove an ink attached to the wiper member when the wiper member is pressed against the wiper cleaning portion, a scraping member actuated in a longitudinal direction of the wiper cleaning portion reciprocatively, and configured to scrape ink attached to the wiper cleaning portion; and a cleaning means for removing ink accumulated on the top portion of the scraping member.

The aforementioned and other aspects, features and advantages will be apparent from the following detailed description when read in conjunction with the accompanying drawings.

DESCRIPTION OF THE PREFERRED EMBODIMENTS

In the following, embodiments of the present invention will be described with reference to the accompanying drawings.

Figure 1:
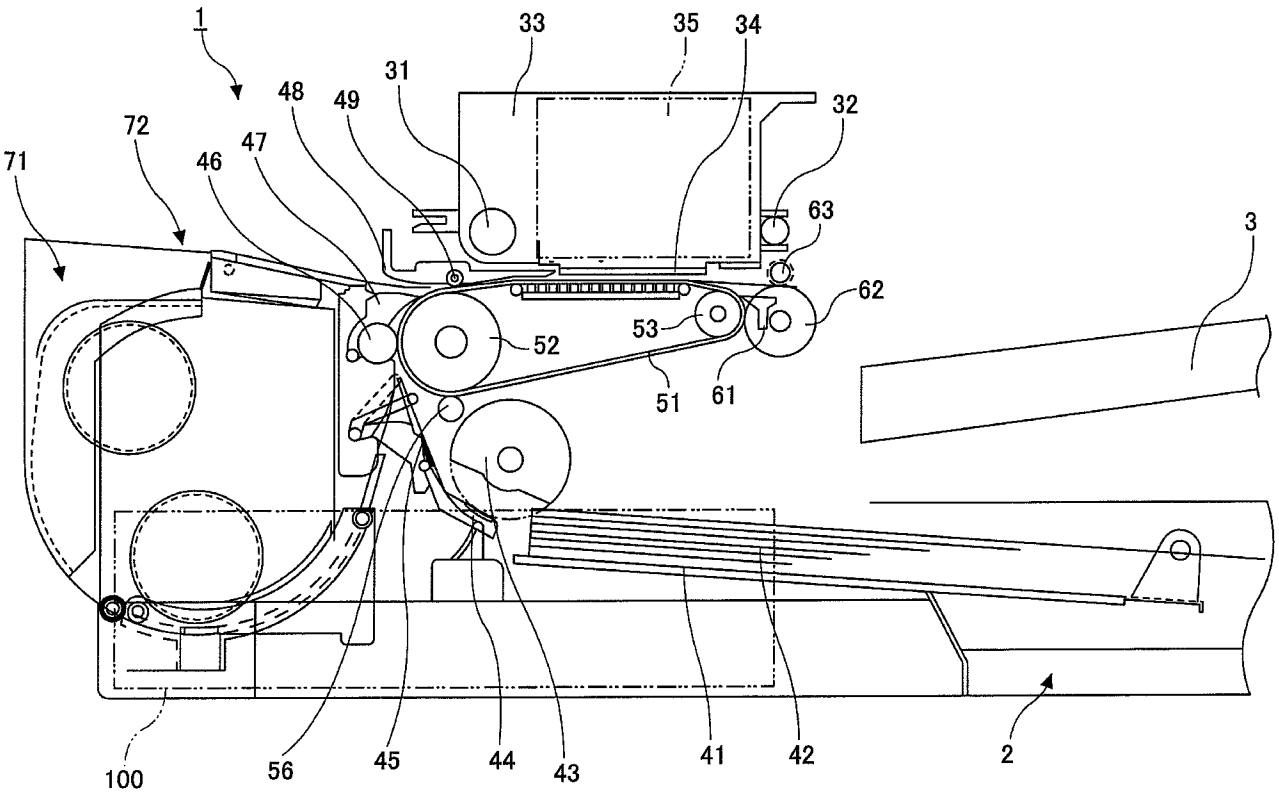
FIG. 1 is a schematic drawing showing a side view of an image forming apparatus according to one embodiment.

FIG. 1 is a schematic drawing showing the side view of an image forming apparatus according to one embodiment.

Figure 2:
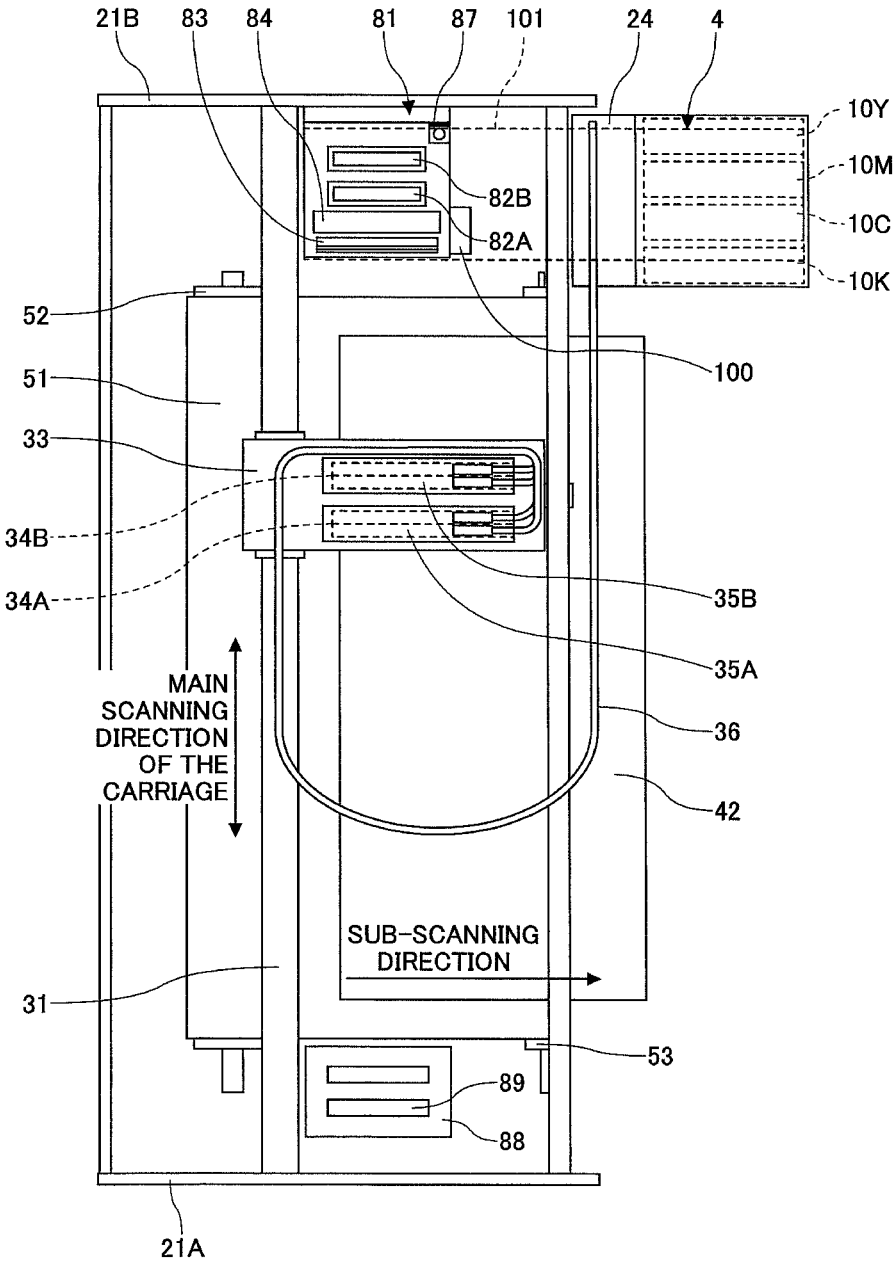
FIG. 2 is a schematic drawing showing a plan view of a main portion of the image forming apparatus according to one embodiment.

FIG. 2 is a schematic drawing showing the plan view of a main portion of the image forming apparatus according to one embodiment.

The image forming apparatus of the present embodiment is a serial type image forming apparatus and includes a main guide rod 31 and a sub-guide rod 32 which are supported at their lateral ends by side boards 21A, 21B. The main guide rod 31 and the sub-guide rod 32 slidably hold a carriage 33. The carriage 33 is scanned by a main scanning motor (not shown) via a timing belt in the direction of an arrow (main scanning direction of the carriage) shown in FIG. 2.

The carriage 33 carries a liquid ejecting head including ejecting heads 34A and 34B which eject ink liquids of yellow (Y), cyan (C), magenta (M), and black (K). A plurality of nozzles are arranged in rows, and the rows of the nozzles are disposed a sub-scanning direction, which is orthogonal to the main scanning direction of the carriage. The ink liquid ejecting direction is directed downwardly.

The ejecting heads 34A and 34B each include two rows of nozzles. The ejecting head 34A ejects black (K) ink liquid from nozzles arranged in one row, and cyan (C) ink liquid from nozzles arranged in a second row. The ejecting head 34B ejects magenta (M) ink liquid from nozzles arranged in one row, and yellow (Y) ink liquid from nozzles arranged in a second row.

Sub-reservoirs 35A, 35B, which reserve the four color ink liquids corresponding to the ink liquids ejected from the ejecting heads 34A and 34B, are mounted on the carriage 33. The ink liquids are delivered from ink cartridges 10Y, 10M, 10C, and 10K to the sub-reservoirs 35A and 35B by a pump unit 35 via delivering lines 36. The ink cartridges 10Y, 10M, 10C, and 10K are detachably attached to a cartridge mounting portion 4.

The image forming apparatus of the present embodiment includes a crescentic shaped roller 43 and a dividing pad 44 which is biased toward the roller 43. The sheets 42 are loaded on a sheet loading portion 41, which is composed of a pressure plate of a feeding tray 2. The roller 43 and the dividing pad 44 are disposed as a sheet feeding portion that feeds sheets 42 one by one from the sheet loading portion 41.

The image forming apparatus of the present embodiment includes a guide portion 45 which guides the sheet 42, a counter roller 46, a guide portion 47, a holding portion 48 which includes a press roller 49, and a feeding belt 51 which adsorbs the sheet 42 by electrostatic adsorption and feeds the sheet 42 relative to the position of the ejecting heads 34A and 34B. The feeding belt 51 is disposed as a feeding portion.

The feeding belt 51 is a looped belt, which is trained about a feeding roller 52 and a tensioned roller 53, and rotates in the sub-scanning direction, i.e. clockwise direction in FIG. 1. The image forming apparatus of the present embodiment includes a charged roller 56 which is electrostatically charged and charges the feeding belt 51. The charged roller 56 contacts the surface of the feeding belt 51, and is rotated by the feeding belt 51. The feeding belt 51 is rotated to in sub-scanning direction shown in FIG. 2 by the feeding roller 52, which is rotated by a sub-scanning motor (not shown).

The image forming apparatus of the present embodiment includes a separating tooth 61, which separates the sheet 42 from the feeding belt 51, a large exit roller 62, a small exit roller 63, and a tray 3 disposed underneath the large exit roller 62.

The image forming apparatus of the present embodiment includes a reversing unit 71 which is detachably attached to a body 1. The reversing unit 71 receives the sheet 42 which is fed by inverse rotation of the feeding belt 51, and then reverses and feeds the sheet 42 between the feeding belt 51 and the counter roller 46. The reversing unit 71 includes a manual sheet feed tray 72 on the top surface thereof.

Figure 3:
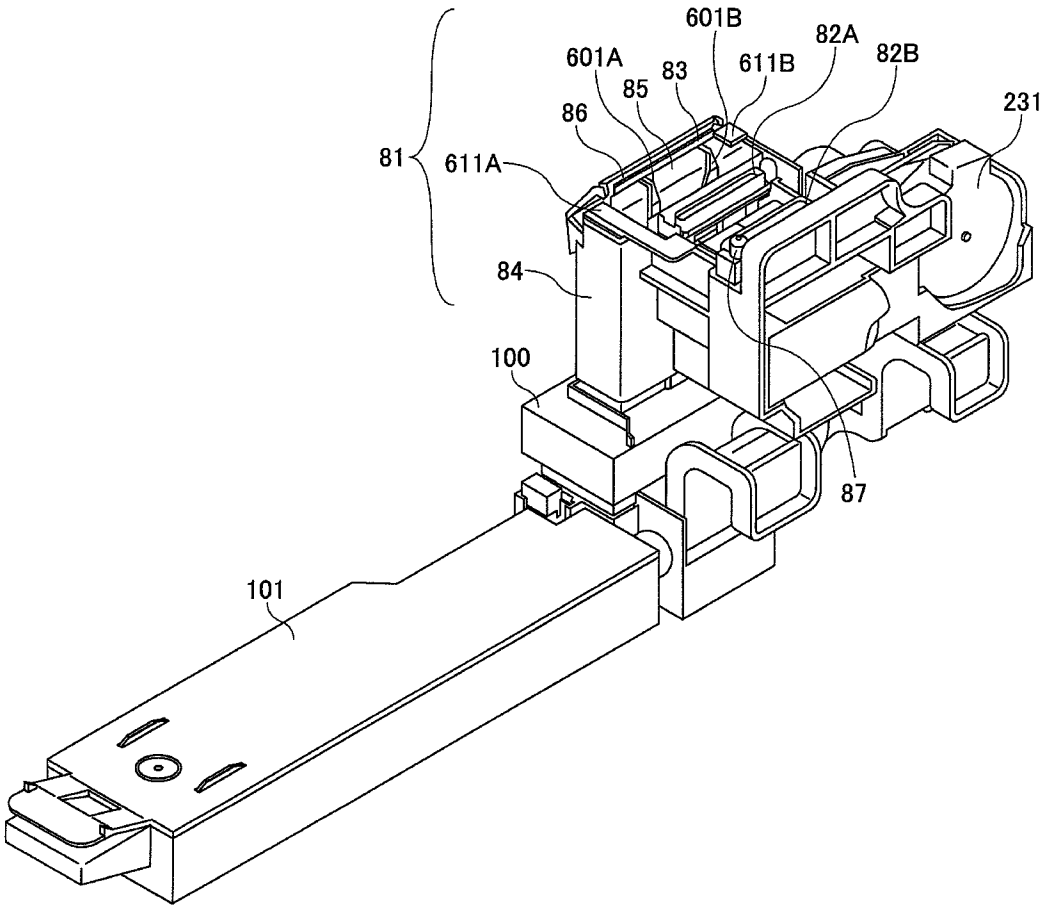
FIG. 3 shows a schematic drawing of a maintaining mechanism 81 in perspective view.

Further, the image forming apparatus of the present embodiment includes a maintaining mechanism 81 that maintains the performance of the ejecting heads 34A and 34B by restoring thereof. The maintaining mechanism 81 is disposed in a non-recording area located at one end of the scanning direction of the carriage 33. The maintaining mechanism 81 includes caps 82A, 82B which cap the nozzle surfaces of the ejecting heads 34A, 34B respectively, a wiper blade (a wiper member) 83 which wipes the nozzle surfaces, a liquid receiving pan 84 which receives a liquid that is not contribute to the recording and is ejected from the ejecting heads 34A, 34B in order to remove a thickened recording liquid attached thereto, and a carriage lock 87 which locks the carriage 33. A waste liquid reservoir 100 is disposed under the maintaining mechanism 81 and reserves a waste liquid which is made during maintenance. The waste liquid reservoir 100 is not replaceable. Another waste liquid reservoir 101 is disposed laterally of the maintaining mechanism 81. The illustrated waste liquid reservoir 101 is replaceable. The waste liquid reservoirs 100 and 101 are shown in FIG. 3 as well.

Referring again to FIG. 2, the image forming apparatus of the present embodiment includes another liquid receiving pan 88 which is disposed in a non-recording area located at the other end of the scanning direction of the carriage 33. The liquid receiving pan 88 receives a liquid that is not contribute to the recording and is ejected from the ejecting heads 34A, 34B in order to remove a thickened recording liquid attached thereto. The liquid receiving pan 88 includes an opening 89 of which the opening shape and size is adapted to the shape and size of an area in which the row of the nozzles of the ejecting head 34A (or 34B) are arranged.

The image forming apparatus as described above feeds the sheet 42 one by one from the feeding tray 2, and guides the sheet 42 upward along the guide portion 45. The sheet 42 is fed in between the belt 51 and the counter roller 46, guided by the guide portion 47, and then pressed to the feeding belt 51 by the press roller 49 by turning round about 90 degrees from the guide portion 45.

The image forming apparatus applies an alternating voltage of plus voltage and minus voltage to the charged roller 56 while the sheet 42 is guided along the feeding belt 51. Thus, the alternative charge distribution of plus charge and minus charge of predetermined length is applied to the feeding belt 51 in the direction of sub-scanning direction, i.e. the rotational direction of the feeding belt 51. When the sheet 42 is fed by the feeding belt 51 with the alternative charge distribution, the sheet 42 is adsorbed electrostatically to the feeding belt 51 and fed in the sub-scanning direction by the rotation of the feeding belt 51.

The image forming apparatus scans the carriage 33, and activates the ejecting heads 34A, 34B in response to an image signal. Thus, the sheet 42 is recorded one line at a time by the ink liquid ejected from the ejecting heads 34A, 34B. The image forming apparatus stops recording of the sheet 42 and ejects the sheet 42 to the ejecting tray 3 when the image forming apparatus detects the end of a page of the sheet 42.

The image forming apparatus scans the carriage 33 to a home position at which the ejecting heads 34A, 34B oppose the maintaining mechanism 81 when the image forming apparatus maintains the ejecting heads 34A, 34B. Then the image forming apparatus suctions the ink liquid in the ejecting heads 34A, 34B with the caps 82A, 82B capped to the nozzle surfaces of the ejecting heads 34A, 34B, and ejects the liquid which is not contribute to the recording in order to maintain the ejecting heads 34A, 34B. Thus, the image forming apparatus can provide image forming with stable ejecting.

Figure 4:
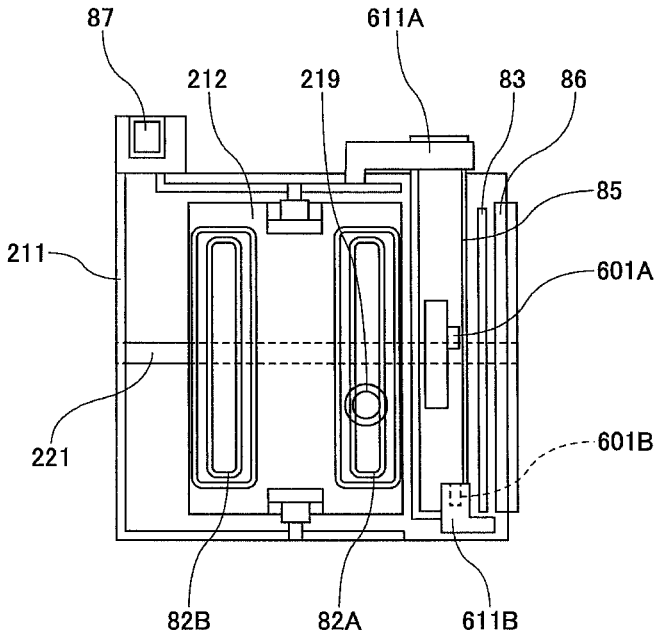
FIG. 4 shows a schematic drawing of the maintaining mechanism 81 in plan view.
Figure 5:
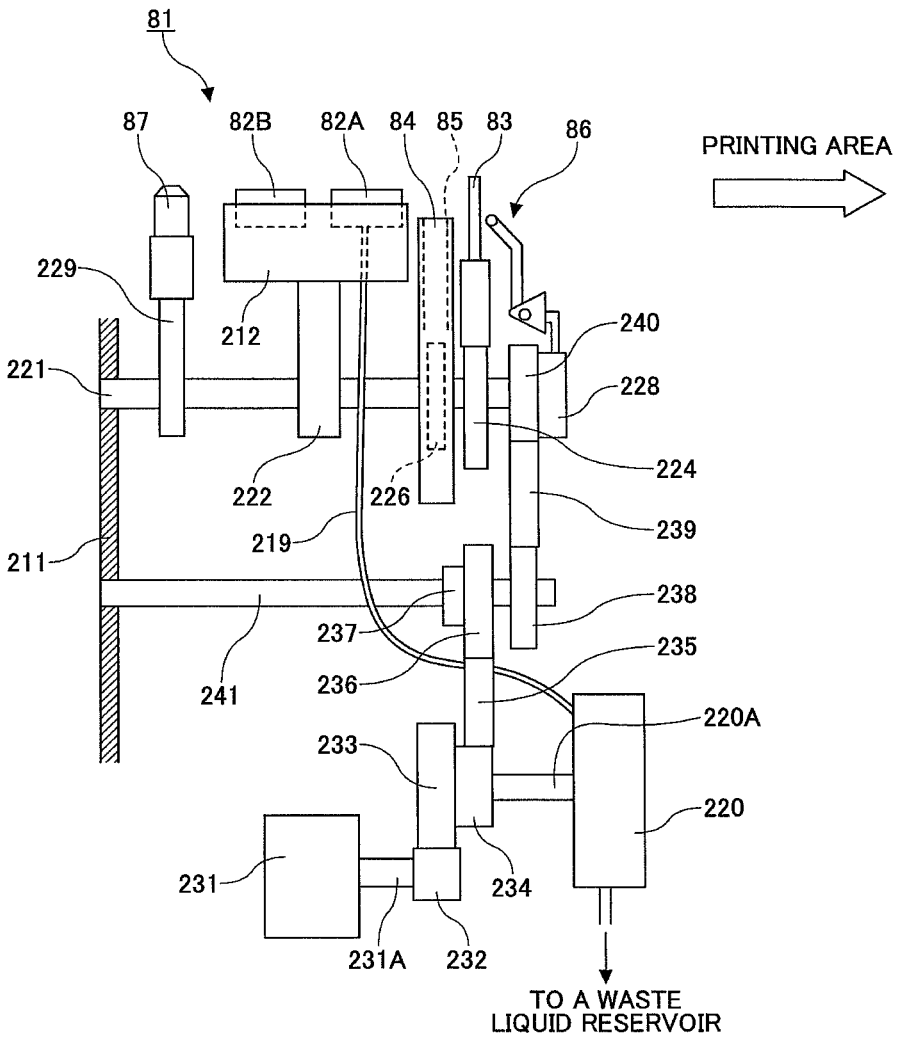
FIG. 5 shows a view showing a frame format of the maintaining mechanism 81.

In the following, the maintaining mechanism 81 of the image forming apparatus will be described with reference to FIGS. 3-5. FIG. 3 shows a schematic drawing of the maintaining mechanism 81 in perspective view. FIG. 4 shows a schematic drawing of the maintaining mechanism 81 in plan view. FIG. 5 shows a view showing a frame format of the maintaining mechanism 81.

The maintaining mechanism 81 includes a frame 211, a cap holder 212, the caps 82A, 82B held by the cap holder 212, a wiper member 83 which includes an elastic member, and a wiper cleaner 86 disposed as a first wiper cleaner. The frame 211, the cap holder 212, the wiper member 83 and the wiper cleaner 86 are held movable upwardly and downwardly.

The liquid receiving pan 84 is disposed between the wiper member 83 and the cap 82A. The cap 82A is used as a suctioning cap. A wiper cleaning portion 85 is formed as a second wiper cleaner (a wiper cleaning portion of the present invention) in order to remove the ink attached to the wiper member 83. The wiper cleaning portion 85 is formed at a top portion of the receiving pan 84 on the wiper member 83 side of the liquid receiving pan 84. The maintaining mechanism 81 removes the ink attached to the wiper member 83 by actuating the wiper member 83 downwardly. In particular, as the wiper member 83 is actuated downwardly, the wiper cleaner 86 cleans the wiper member 83 by pressing the wiper member 83 against the wiper cleaning portion 85. Then the ink removed from the wiper member 83 falls down to the liquid receiving pan 84.

A tubing pump (a suction pump) 220 is connected to the cap 82A via a flexible tube 219. In the illustrated embodiment, the cap 82A is disposed closer to a printing area than the cap 82B. The cap 82A is used as a auctioning cap (a restoring cap) and a moisturizing cap (hereinafter referred to simply as a "auctioning cap"). The cap 82B is used as a moisturizing cap. When the maintaining mechanism 81 restores the ejecting head 34A (or 34B), the ejecting head 34A (or 34B) is moved to a position at which the ejecting head 34A (or 34B) can be capped by the cap 82A.

A camshaft 221 is rotatably supported by the frame 211 underneath the caps 82A, 82B, and the wiper member 83. A cap cam 222, a wiper cam 224, a roller 226, a cleaner cam 228, and a carriage cam 229 are connected to the camshaft 221, and rotate with the camshaft 221. The cap cam 222 is disposed to actuate a cap holder 212 upwardly and downwardly. The wiper cam 224 is disposed to actuate wiper member 83 upwardly and downwardly. The roller 226 is disposed to a position at which the roller 226 receives the liquid ejected from the ejecting head 34A or 34B. The cleaner cam 228 is disposed to swing the wiper cleaner 86. The carriage cam 229 is disposed to actuate the carriage lock 87 upwardly and downwardly.

The maintaining mechanism 81 includes a drive mechanism which rotates the camshaft 221 and thereby drives the suction pump 220 as follows. A middle gear 234 of the pump gear 233 is connected to a pump shaft 220A of the suction pump 220. The pump gear 233 and the middle gear 234 are formed integrally. The pump gear 233 is engaged with a motor gear 232 which, in turn, is connected to a shaft 231A of the motor 231. A middle gear 235 is engaged between the middle gear 234 and a middle gear 236 which is connected to a middle shaft 241 via a one way clutch 237. A middle gear 238 is connected to the middle shaft 241, i.e. the middle gears 236 and 238 are coaxially connected to the middle shaft 241. A middle gear 239 is engaged between the middle gear 238 and a cam gear 240. The cam gear 240 is connected to the camshaft 221. The middle shaft 241, which is a rotation axis of the middle gears 236 and 238, is rotatably supported by the frame 211.

The maintaining mechanism 81 drives the motor 231 and actuates the wiper member 83 upwardly via the wiper cam 224 which is connected to the camshaft 221 to remove an ink or a particle attached to the nozzle surface of the ejecting head 34A (or 34B). In this condition, the maintaining mechanism 81 scans the carriage 33 to the main scanning direction. The wiper member 83 wipes the ink or the particle attached on the nozzle surface of the ejecting head 34A (or 34B).

The longer the nozzle surfaces of the ejecting heads 34A, 34B are left uncapped, the greater the likelihood that the ink liquid which remains inside the ejecting heads 34A, 34B will become thickened or dried, and the ejecting performance of the ejecting heads 34A, 34B will be decreased. The maintaining mechanism 81 caps the nozzle surfaces of the ejecting heads 34A, 34B, with the caps 82A, 82B and thus prevents the ink liquid from becoming thickened or dried by driving the motor 231 and actuating the caps 82A, 82B upwardly.

Figure 6:
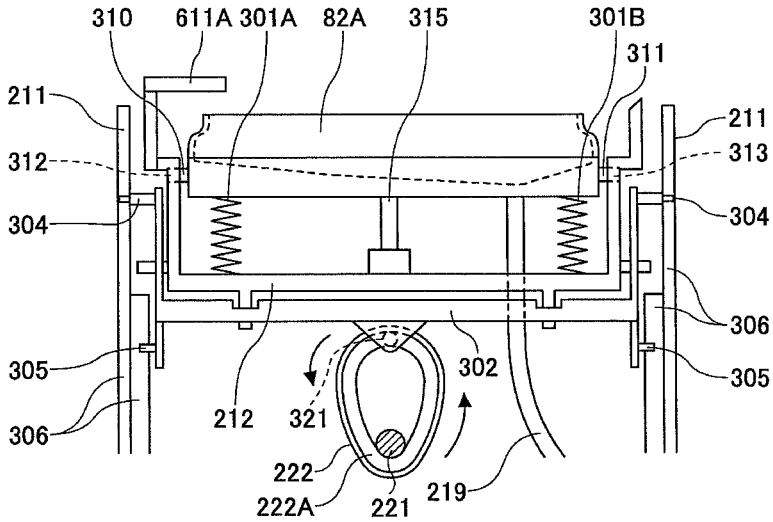
FIG. 6 shows a schematic drawing of an elevating mechanism for caps 82A, 82B in side view.

In the following, an elevating mechanism for the caps 82A, 82B of the image forming apparatus will be described with reference to FIG. 6. FIG. 6 shows a schematic drawing of the elevating mechanism for the caps 82A, 82B in side view. Herein, the caps 82A, 82B are actuated upwardly and downwardly by the same elevating mechanism, although the invention is not limited to this. In the following, the elevating mechanism for the cap 82A will be described representatively.

The cap 82A is held movable upwardly and downwardly by the cap holder 212 which is disposed as a cap holding member. Springs 301A, 301B are inserted between the cap 82A and the cap holder 212 and bias the cap 82A upwardly with regard to the cap holder 212.

The cap holder 212 is held movable forwardly and backwardly (in the direction in which the rows of the nozzles are arranged, i.e. the main scanning direction of the carriage (see FIG. 2)) by a slider 302. The slider 302 includes guide pins 304, 305 on front and rear sides. The guide pins 304, 305 are slidably fit into guide rails 306 formed in the frame 211. The slider 302, the cap holder 212, and the cap 82A are movable upwardly and downwardly as a whole by the cap cam 222 which contacts the slider 302.

Guide pins 310, 311 are attached on opposite sides of the cap 82A in the longitudinal direction thereof, and catching holes 312, 313, which receive the guide pins 310, 311, are formed in the cap holder 212. Herein, recessed portions or grooves may be formed in the cap holder 212 instead of the catching holes 312, 313.

A guide pin 315 is attached on the bottom surface of the cap 82A. The guide pin 315 is inserted into a flange portion 212A of the cap holder 212 in a manner that the guide pin 315 is movable upwardly and downwardly with respect to the cap holder 212. Thus the cap 82A is held by the cap holder 212 and is movable upwardly and downwardly with respect to the cap holder 212. The springs 301 inserted between the cap 82A and the cap holder 212 bias the cap 82A upwardly (to the direction in which the cap 82A is biased toward the nozzle surfaces).

The flexible tube 219 is connected to a portion of the bottom portion of the cap 82A and passes through the slider 302 and the cap holder 212. In the illustrated embodiment, the portion of the bottom portion of the cap 82A is offset from the midpoint in the longitudinal direction and located in the midpoint in the direction orthogonal to the longitudinal direction.

A cam pin 321 is attached to the slider 302 which holds the cap holder 212. The cam pin 321 contacts with a groove 222A formed in the cap cam 222. The cap 82A is actuated upwardly and downwardly by the slider 302 which is actuated upwardly and downwardly by the rotation of the cap cam 222.

Figure 7:
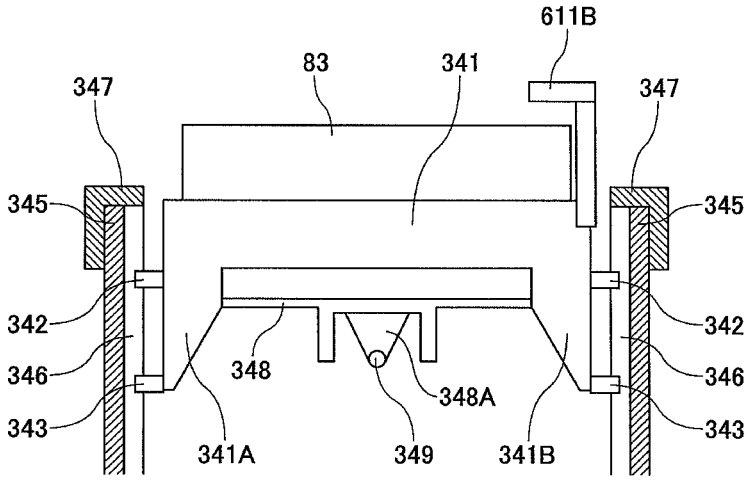
FIG. 7 shows a schematic drawing of an elevating mechanism for a wiper member 83 in side view.

In the following, an elevating mechanism for the wiper member 83 of the image forming apparatus will be described with reference to FIG. 7. FIG. 7 shows a schematic drawing of the elevating mechanism for the wiper member 83 in side view.

The wiper member 83 is attached to a wiper holder 341. Guide pins 342, 343 are attached to both sidewall portions of the wiper holder 341 and are received in guide rails 346 formed in a guide portion 345, in order to make the wiper member 83 slidable upwardly and downwardly. Stopper members 347 are disposed on the top portion of the guide rails 346 in order to stop the guide pins 342 when the guide pins are slid up to the top of the guide rails 346. Thus, the stoppers 347 restrict elevation of the wiper member 83.

An elastic member 348 is attached to the bottom portion between foot portions 341A, 341B of the wiper holder 341. A cam pin 349 is attached to a convexed portion 348A which is formed on the bottom surface of the elastic member 348. The cam pin 349 slidably contacts a cam groove of the wiper cam 224.

Figure 8:
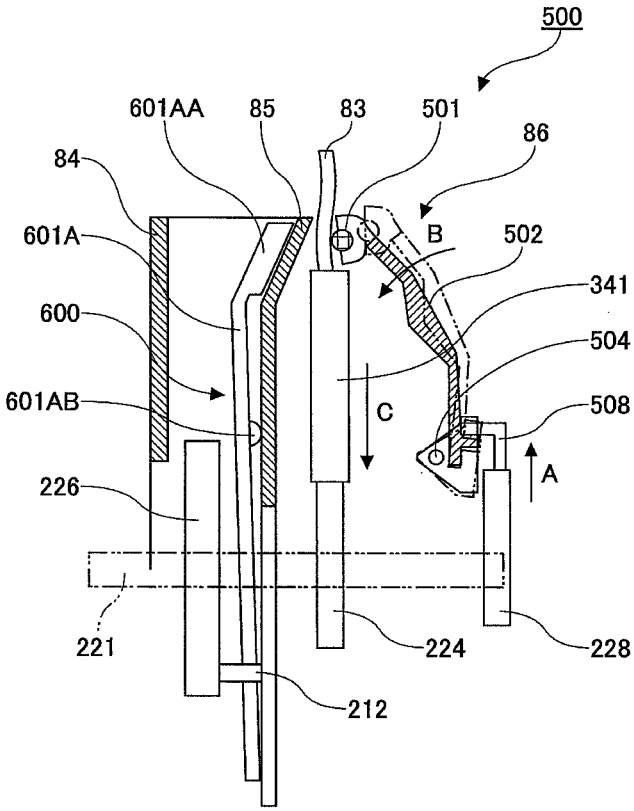
FIG. 8 shows a schematic drawing of a wiper cleaning mechanism for the wiper member 83 in cross sectional front view in a state where cleaning the wiper member 83 is being cleaned.

In the following, a wiper cleaning mechanism for the wiper member 83 of the image forming apparatus will be described with reference to FIG. 8. FIG. 8 shows a schematic drawing of the wiper cleaning mechanism for the wiper member 83 in cross sectional front view when cleaning the wiper member 83.

The wiper cleaning mechanism 500 includes the wiper cleaner 86 which presses the wiper member 83 to the side of the liquid receiving pan 84, and the wiper cleaning portion 85 which is formed with the liquid receiving pan 84 in an integrated fashion.

The wiper cleaner 86 includes a cleaner roller 501 which is disposed at the top portion of a cleaner holder 502 in rotatable fashion. The cleaner roller 501, by contacting the wiper member 83, cleans ink attached to the wiper member 83. The cleaner holder 502 is swingably supported by a pivot 504 which is attached to the frame 211, and biased by a spring (not shown) to a position away from the wiper member 83 at which the cleaner roller 501 does not contact the wiper member 83. A link member 508 swings the cleaner holder 502 toward and away from the wiper member 83. The link member 508 is actuated by the cleaner cam 228 when the camshaft 221 rotates.

The wiper cleaning portion 85 is formed at a top portion of the wiper member 83 side of the liquid receiving pan 84 in an integrated fashion. The wiper cleaning portion 85 is formed to be declined relative to the wiper member 83 and pinches the wiper member 83 with the cleaner roller 501.

The wiper member 83 is actuated upwardly by the wiper cam 224 when the camshaft 221 rotates, and wipes the ejecting head 34A (or 34B) which is moved close to the wiper member 83. Then the link member 508 is actuated upwardly in the direction of arrow A in FIG. 8 to swing the cleaner holder 502 in the direction of the arrow B, which causes the cleaner roller 501 to press the wiper member 83 toward and into contact with the wiper cleaning portion 85.

The wiper member 83 is then actuated downwardly in the direction of arrow C by continued rotation of the wiper cam 224, which causes the wiper cleaning portion 85 to scrape ink attached to the wiper member 83 down into the liquid receiving pan 84.

Figure 9:
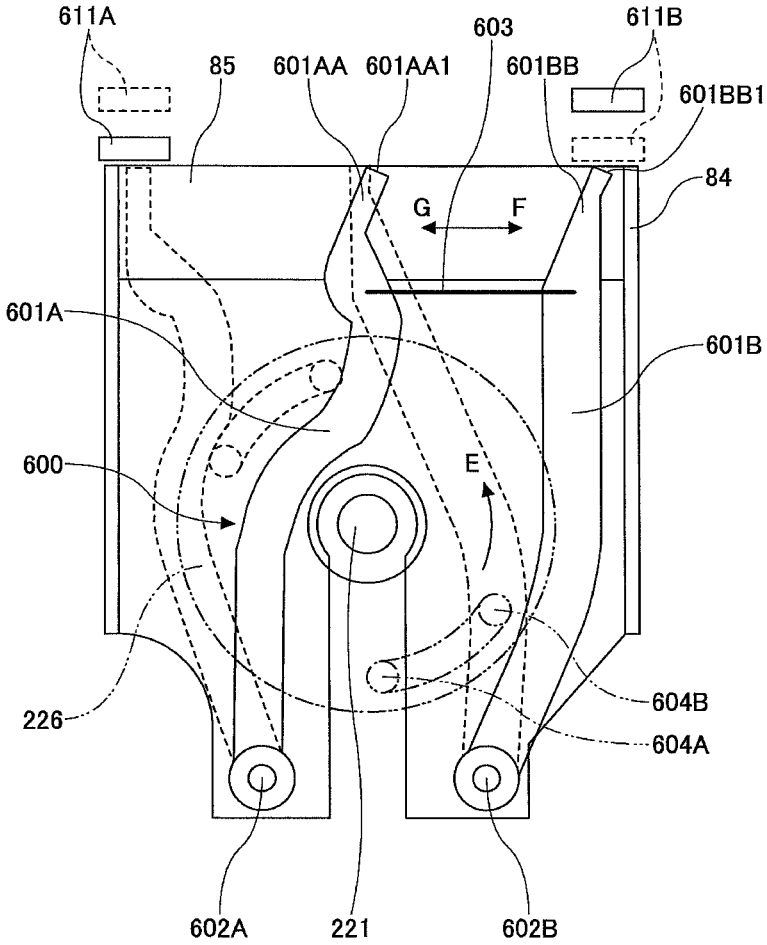
FIG. 9 shows a schematic drawing of a portion of a scraping mechanism for the wiper cleaning portion 85 in side view.

In the following, a scraping mechanism which cleans the wiper cleaning portion 85 will be described with reference to FIGS. 8 and 9. FIG. 9 shows a schematic drawing of a portion of the scraping mechanism for the wiper cleaning portion 85 in side view.

A scraping mechanism 600 includes scraping members 601A, 601B which scrape ink attached to the inner surface of the wiper cleaning portion 85. The scraping members 601A, 601B are disposed as scraping means. The scraping members 601A, 601B are swingably supported by pivots 602A, 602B respectively, and are connected to each other by a link member 603.

Pin members 604A, 604B are attached on the side surface of the roller 226, and contact the scraping members 601A, 601B when the roller 226 rotates.

Distal portions 601AA, 601BB of the scraping members 601A, 601B are declined to follow the declined surface of the wiper cleaning portion 85. A convexed portion 601AB of the scraping member 601A is formed on a surface opposite to the inner surface of the liquid receiving pan 84, as shown in FIG. 8. The convexed portion 601AB minimizes the amount of area of the inner surface of the liquid receiving pan 84 that the scraping member 601A contacts when the scraping member 601A is actuated. Herein, only the scraping member 601A is shown in FIG. 8, the scraping member 601B shown in FIG. 9 includes a convexed portion as same as the 601AB.

According to the image forming apparatus of the present embodiment, ink is removed from the wiper member 83 by the wiper cleaning portion 85, and then becomes attached to the wiper cleaning portion 85. As the roller 226, rotated by the camshaft 221, rotates in the direction of arrow E in FIG. 7, the pin members 604A, 604B of the roller 226 contact the scraping members 601A, 601B to reciprocatively move the scraping members 601A, 601B the direction of arrows F and G (herein the solid line indicates the position of the scraping members 601A, 601B when actuated in the direction of arrow F, and the dotted line indicates the position of the scraping members 601A, 601B when actuated in the direction of arrow G). The ink removed by the wiper cleaning portion 85 gathers at the distal portions 601AA, 601BB of the reciprocating scraping members 601A, 601B, and then gradually becomes one or more clumps. The clumps of the ink drop or tumble down along the inner surface of the liquid receiving pan 84 under own weight.

In the following, a scraping member cleaning mechanism which cleans the scraping members 601A, 601B will be described.

The scraping member cleaning mechanism includes a first cleaning member 611A which removes ink accumulated on the distal portion 601AA of the scraping member 601A, and a second cleaning member 611B which removes ink accumulated on the distal portion 601BB of the scraping member 601B. The first cleaning member 611A and the second cleaning member 611B are disposed at top portions at both ends of the wiper cleaning portion 85. Since the first cleaning member 611A and the second cleaning member 611B are disposed at both ends of and apart from the wiper cleaning portion 85, the first cleaning member 611A and the second cleaning member 611B do not obstruct a flushing liquid drop (a liquid that is not contribute to the recording) from being introduced into the liquid receiving pan 84 from thereabove. Thus, the width therebetween (shown in FIG. 9) is not to be widened.

The first cleaning member 611A and the second cleaning member 611B are disposed movably in a manner that the first cleaning member 611A and the second cleaning member 611B move upwardly away from the top portions of the liquid receiving pan 84 when the scraping members 601A, 601B are actuated from the middle portion of the longitudinal direction of the wiper cleaner 85 to the end portion thereof respectively, and move downwardly toward the top portions of the liquid receiving pan 84 to a position to slidably contact and thereby remove the ink from the scraping members 601A, 601B when the scraping members 601A, 601B are actuated from the end portion to the middle portion of the wiper cleaner 85.

Herein, absorbing members for absorbing ink accumulated on the scraping members 601A, 601B may be attached to the first cleaning member 611A and the second cleaning member 611B respectively. The ink removing performance is improved by attaching the absorbing members. Further, the distance between the cleaning members 611A, 611B and the scraping members 601A, 601B can be shortened by attaching the absorbing members. Thus, the ink removing performance is yet improved by shortening the distance therebetween.

As described above, the scraping members 601A, 601B are connected to each other. The scraping members 601A, 601B are connected to each other such that when the scraping member 601A is actuated from the middle portion (indicated by the solid line) to the left end portion (indicated by the dotted line), the scraping member 601B is actuated from the right end portion (indicated by the solid line) to the middle portion (indicated by the dotted line). This is also as shown in FIG. 10.

As described above, the first cleaning member 611A is attached to the cap holder 212 which holds the caps 82A, 82B, and is actuated to be reciprocatively moved upwardly away from and downwardly toward the top portions of the liquid receiving pan 84 in a manner associated with the movement of the caps 82A, 82B. The second cleaning member 611B is attached to the wiper holder 341 which holds the wiper member 83, and is actuated to be reciprocatively moved upwardly away from and downwardly toward the top portions of the liquid receiving pan 84 in a manner associated with the movement of the wiper member 83.

Figure 11:
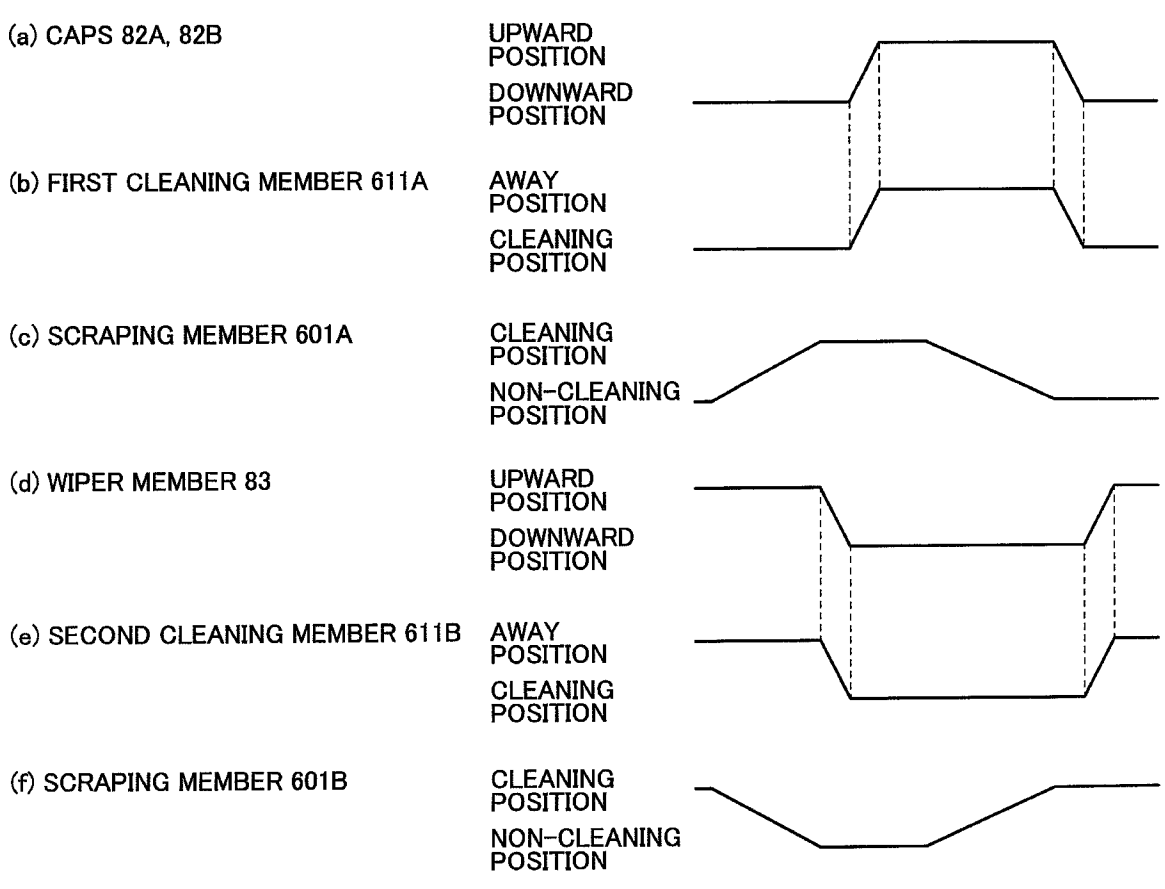
FIG. 11 shows a timing chart of actuating the caps 82A, 82B, a first cleaning member 611A, a scraping member 601A, the wiper member 83, a second cleaning member 611B, and a scraping member 601B.

Thus, as the caps 82A, 82B are actuated from the downward position to the upward position as shown in (a) of FIG. 11, the first cleaning member 611A is actuated from a cleaning position to an away position as shown in (b) of FIG. 11. As the wiper member 83 is actuated from the upward position to the downward position as shown in (d) of FIG. 11, the second cleaning member 611B is actuated from an away position to a cleaning position with predetermined time delay as shown in (e) of FIG. 11.

Figure 10:
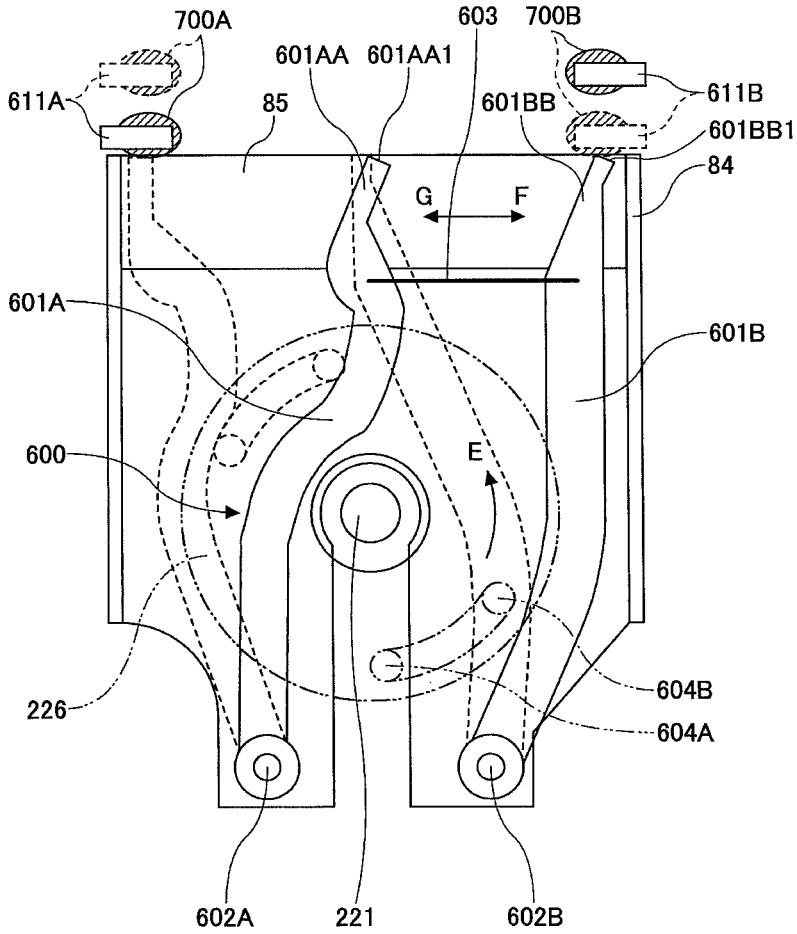
FIG. 10 shows a schematic drawing of a portion of the scraping mechanism for the wiper cleaning portion 85 in side view in a state where the ink is being removed by cleaning members.

Before the wiper member 83 is actuated from the upward position to the downward position, the scraping member 601A is moved to be located in the cleaning position (the middle portion), and the scraping member 601B is moved to be located in the non-cleaning position (right end portion) as shown (c) and (f) of FIG. 11, and FIG. 10. The relationship of the positions as described above is caused by the relationship of the position of the pin members 604A, 604B of the roller 226, the cap cam 222, and the wiper cam 224.

After the wiper member 83 is actuated to the downward position, the scraping member 601A is actuated from the cleaning position (the middle portion) to the non-cleaning position (the left end portion), and the scraping member 601B is actuated from the non-cleaning position (the right end portion) to the cleaning position (the middle portion). In this case, as shown in FIG. 10, the ink 700B attached to an end portion 601BB1 of the distal portion 601BB is removed by the second cleaning member 611B.

When the scraping member 601A is actuated from the non-cleaning position to the cleaning position, the first cleaning member 611A is located in the cleaning position. Thus, the ink 700A attached to an end portion 601AA1 of the distal portion 601AA is removed by the first cleaning member 611A.

Since the image forming apparatus of the present embodiment includes the cleaning member which removes ink attached to the distal portion of the scraping member wherein the scraping member scrapes the ink attached to the wiper cleaning portion, the amount of ink attached to the scraping member can be reduced, and contact of the ink to the ejecting head and spotting of the ink to the sheet can be reduced.

The scraping members 601A, 601B which scrape ink attached to the inner surface of the wiper cleaning portion 85 may cause deposition of the ink to the end portions 601AA1, 601BB1 of the scraping members 601A, 601B, because the ink attached thereto becomes greatly thickened with each scraping. Thus, the attached ink may cause degradation of the recording quality by contacting the ejecting head.

However, the image forming apparatus of the present embodiment includes the scraping member cleaning mechanism which removes the ink deposited on and around the top end portions 601AA1, 601BB1 of the scraping members 601A, 601B. Thus the contact of ink to the ejecting head and the spotting of ink attached to the scraping members 601A, 601B to the sheet, will be prevented for a long period, and the reliability of the image forming apparatus is improved.

Herein, if the scraping member cleaning mechanism is fixed to the top portion of the liquid receiving pan 84, it becomes necessary to keep the distance between the scraping member cleaning mechanism and the top end portions 601AA1, 601BB1 of the scraping members 601A, 601B in views of tolerances thereof in order to prevent obstruction of the scraping member cleaning mechanism to the scraping members 601A, 601B. This results in degradation of removing efficiency of the ink.

Further, since ink attached to the top end portions of the scraping members 601A, 601B is transferred to the scraping member cleaning mechanism with each scraping, the ink may be deposited to the top side of the scraping member cleaning mechanism.

However, as described above, the image forming apparatus of the present embodiment includes an actuating mechanism which actuates the scraping members 601A, 601B to the cleaning position or the non-cleaning position, and actuates the cleaning members 611A, 611B to the cleaning position or the away position in a manner as described above. The first cleaning member 611A is actuated to the cleaning position within the predetermined period after the scraping member 601A is actuated to the non-cleaning position, and is actuated to the away position within the predetermined period after the scraping member 601A is actuated to the cleaning position. The second cleaning member 611B is actuated to the cleaning position within the predetermined period after the scraping member 601B is actuated to the non-cleaning position, and is actuated to the away position within the predetermined period after the scraping member 601B is actuated to the cleaning position. Thus, the image forming apparatus of the present embodiment can prevent the deposition of the ink to the cleaning members 611A, 611B and the degradation of removing efficiency of the ink.

According to the image forming apparatus of the present embodiment, as described above, the cleaning members 611A, 611B are actuated by the actuating mechanism which actuates the scraping members 601A, 601B. Thus, it is not necessary to add an actuating mechanism besides the actuating mechanism which actuates the scraping members 601A, 601B in order to actuate the cleaning members 611A, 611B. Further, it becomes possible to actuate the cleaning members 611A, 611B at just an appropriate time to the actuation of the scraping members 601A, 601B. The caps 82A, 82B, the tubing pump 220, the wiper member 83, the wiper cleaner 86, the scraping members 601A, 601B, the cleaning members 611A, 611B, and the roller 226 are actuated by the camshaft 221 which is rotated by the motor 231. Thus, the composition of the image forming apparatus becomes simple, and the cost for manufacturing thereof becomes lower.

Herein, the image forming apparatus of the present invention can be applied to a facsimile machine, a copier, and a complex machine of a printing machine, a facsimile machine, and a copier etc. Further, the image forming apparatus of the present invention can be used for ejecting a liquid besides the ink, i.e. for example a resist, or a liquid including a DNA sample.

Further, the present invention is not limited to the embodiment, but variations and modifications may be made without departing from the scope of the present invention.

The present application is based on Japanese Priority Application No. 2008-131479 filed on May 20, 2008 with the Japanese Patent Office, the entire contents of which are hereby incorporated by reference.

What is claimed is:

1. An image forming apparatus comprising:

an ejecting head including a nozzle from which an ink is ejected;

a cap member configured to suction the nozzle of the ejecting head;

a wiper member configured to wipe ink from a surface of the nozzle of the ejecting head;

a liquid receiving member provided between the wiper member and the cap member and having a hollow shape;

a wiper cleaning portion integrally formed with the liquid receiving member and configured to remove an ink attached to the wiper member when the wiper member is pressed against the wiper cleaning portion, a scraping member actuated in a longitudinal direction of the wiper cleaning portion reciprocatively, and configured to scrape ink adhered to an inner surface of the wiper cleaning portion in the liquid receiving member; and a cleaning member configured to remove ink accumulated at a tip portion of the scraping member, wherein the scraping member is swingably supported by a pivot provided at a lower edge portion of the liquid receiving member, said pivot supporting a lower end of the scraping member, the scraping member reciprocatively moves so as to collect the ink adhered to the inner surface of the wiper cleaning portion at the tip portion of the scraping member, the cleaning member is provided above at least one of two end sides of the liquid receiving member so as to move to and away from the wiper cleaning portion for removing the ink adhered to the tip portion of the scraping member, the cleaning member is configured to move upwardly and downwardly between a cleaning position to clean the tip portion of the scraping member and an away position, based on a reciprocative movement of the scraping member, said cleaning member being configured to move to the away position when the scraping member moves toward the cleaning member, and said cleaning member being configured to move to the cleaning position to clean the tip portion of the scraping member when the scraping member reaches a position directly below the cleaning member, and the cleaning member has a plate shape including a bottom face that is substantially horizontal, and when the cleaning member is in the cleaning position, the substantially horizontal bottom face of the cleaning member is positioned above the scraping member and contacts at least a portion of the ink adhered to the tip portion of the scraping member, for transferring the ink from the scraping member to the cleaning member to avoid the ink to be adhered and deposited on the top side of the cleaning member.

2. The image forming apparatus as claimed in claim 1, wherein the cleaning member is actuated to move away from the scraping member to the away position when the scraping member is actuated from a middle portion of the longitudinal direction of the wiper cleaning portion to an end portion thereof, and is actuated to move to the cleaning position and contact the scraping member in order to remove the ink accumulated on the tip portion of the scraping member when the scraping member is actuated from the end portion to the middle portion.

3. The image forming apparatus as claimed in claim 1, wherein the cleaning member is actuated in a manner associated with movement of a cap member which is actuated upwardly and downwardly and caps the nozzle of the ejecting head when actuated upwardly.

4. The image forming apparatus as claimed in claim 1, wherein the cleaning member is actuated in a manner associated with movement of the wiper member which is actuated upwardly and downwardly when the ink attached to the wiper member is removed by the wiper cleaning portion.

5. The image forming apparatus as claimed in claim 1, wherein the cleaning member is disposed at both ends of and apart from the wiper cleaning portion.

6. The image forming apparatus as claimed in claim 1, further comprising an absorbing member which is attached to the cleaning member and absorbs ink attached to the scraping member.

7. The image forming apparatus as claimed in claim 1, wherein the cleaning member only moves to the cleaning position, to contact and clean the tip portion of the scraping member, at a predetermined time period after the scraping member has already reached a position directly adjacent to the cleaning member.

8. The image forming apparatus as claimed in claim 1, wherein the cleaning member does not contact the tip portion of the scraping member before a predetermined time period has elapsed after the scraping member has reached a position directly adjacent to the cleaning member.

9. The image forming apparatus as claimed in claim 1, wherein the cleaning member is actuated to move downward from the away position to the cleaning position, and is actuated to move upward from the cleaning position to the away position.

10. The image forming apparatus as claimed in claim 1, wherein when the cleaning member is disposed at the cleaning position, there is an intervening space vertically between the cleaning member and the tip portion of the scraping member.

* * * * *